US008105026B2

(12) United States Patent
Eguchi et al.

(10) Patent No.: US 8,105,026 B2
(45) Date of Patent: Jan. 31, 2012

(54) CENTRIFUGAL BLOWER

(75) Inventors: Tsuyoshi Eguchi, Hyogo (JP); Atsushi Suzuki, Aichi (JP); Mitsuhiro Nakao, Hyogo (JP); Tetsuo Tominaga, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 761 days.

(21) Appl. No.: 12/224,442

(22) PCT Filed: May 8, 2008

(86) PCT No.: PCT/JP2008/058556

§ 371 (c)(1),
(2), (4) Date: Aug. 27, 2008

(87) PCT Pub. No.: WO2008/143007

PCT Pub. Date: Nov. 27, 2008

(65) Prior Publication Data

US 2010/0226766 A1 Sep. 9, 2010

(30) Foreign Application Priority Data

May 11, 2007 (JP) ..... 2007-126471

(51) Int. Cl.
*F04D 29/44* (2006.01)

(52) U.S. Cl. ..... 415/204

(58) Field of Classification Search ..... 415/204, 415/206, 211.1
See application file for complete search history.

(56) References Cited

U.S. PATENT DOCUMENTS

| | | | | |
|---|---|---|---|---|
| 5,570,996 | A * | 11/1996 | Smiley, III | 415/53.2 |
| 7,290,981 | B2 * | 11/2007 | Guzorek | 415/151 |
| 7,883,312 | B2 * | 2/2011 | Eguchi et al. | 415/119 |
| 2002/0119044 | A1 * | 8/2002 | O'Connor et al. | 415/204 |
| 2008/0279681 | A1 * | 11/2008 | Eguchi et al. | 415/206 |
| 2010/0251692 | A1 * | 10/2010 | Kinde, Sr. | 60/226.1 |

FOREIGN PATENT DOCUMENTS

JP 54-182922 U 12/1979

(Continued)

OTHER PUBLICATIONS

Japanese Office Action dated May 24, 2011, issued in corresponding Japanese Patent Application No. 2007-126471.

*Primary Examiner* — Gary F. Paumen
(74) *Attorney, Agent, or Firm* — Westerman, Hattori, Daniels & Adrian, LLP

(57) ABSTRACT

It is intended to provide a centrifugal blower capable of suppressing the generation of noise including periodic noise that is caused by interference between a tongue and an impeller. The centrifugal blower is provided with an impeller (2) provided with plural blades around a rotating shaft; a casing (3) which houses the impeller (2) and has a suction portion at one end in an axial line direction of the rotating shaft; a spiral flow passage (4) formed around the impeller (2) in the casing (3); and a tongue (6) for suppressing inflow of air from a winding end to a winding origin of the spiral flow passage (4). The centrifugal blower is characterized in that an extension (20) is provided at a tip of the tongue (6) in a reverse rotational direction that is reverse to a rotational direction of the impeller (2) in such a manner that it projects in the reverse rotational direction by a length that varies depending on the position in the axial line direction and that the gap between itself and the impeller (2) in the radial direction of the impeller (2) is kept approximately constant.

9 Claims, 8 Drawing Sheets

FOREIGN PATENT DOCUMENTS

| | | | |
|---|---|---|---|
| JP | 59-123698 | U | 8/1984 |
| JP | 6-117397 | A | 4/1994 |
| JP | 2002-339899 | A | 11/2002 |
| JP | 2006-283689 | A | 10/2006 |

* cited by examiner

CENTRIFUGAL BLOWER

TECHNICAL FIELD

The present invention relates to a centrifugal blower which is suitable for suppressing the generation of periodic noise.

BACKGROUND ART

In centrifugal blowers, it is known that periodic noise is generated by interference between an impeller and a tongue. This periodic noise has blade-passing-frequency whose frequency is proportional to the rotational speed (N) and the number of blades (Z) of the impeller.

In one known method for suppressing such periodic noise, a large gap is formed between the outer diameter of the impeller and the tongue. However, this method deteriorates the aerodynamic performance of the centrifugal blower. Therefore, to maintain the aerodynamic performance, that is, the airflow rate, it is necessary to increase the rotational speed of the impeller. However, this results in a problem that the overall noise level (which corresponds to an integration value of noise at respective audible frequencies) of the centrifugal blower is deteriorated.

An example technique (refer to Patent Citation 1, for example) for solving the above problem was proposed in which the generation of periodic noise is suppressed by varying the timing of interference between the tongue and the impeller by varying the ratio (tongue gap ratio s/D2) between the diameter D2 of the impeller and the gap s between the tongue and the impeller in the height direction of the impeller.

Patent Citation 1: Japanese Unexamined Patent Application, Publication No. 2002-339899.

DISCLOSURE OF INVENTION

However, in the technique of the above Patent Citation 1, there is a possibility that the tongue gap ratio thus varied is deviated from an optimum value to generate the noise other than periodic noise. And there is another problem that the generation of periodic noise is not suppressed sufficiently.

The present invention has been made to solve the above problems, and an object of the invention is therefore to provide a centrifugal blower capable of suppressing the generation of noise including periodic noise that is caused by interference between the tongue and the impeller.

To attain the above object, the invention provides the following means.

The invention provides a centrifugal blower comprising an impeller provided with plural blades around a rotating shaft; a casing which houses the impeller and has a suction portion at one end in an axial line direction of the rotating shaft; a spiral flow passage formed around the impeller in the casing; a tongue for suppressing inflow of air from a winding end to a winding origin of the spiral flow passage; and an extension which is provided at a tip of the tongue in a reverse rotational direction that is reverse to a rotational direction of the impeller and which projects in the reverse rotational direction by a length that varies depending on the position in the axial line direction while the gap between the extension and the impeller in a radial direction of the impeller is kept approximately constant.

According to the invention, air that has flown into the spiral flow passage from the impeller flows along the spiral flow passage and collides with the extension to form a high-pressure region. Since the region where the high-pressure region is formed is influenced by the position where the air collides with the extension, it varies depending on the position in the axial line direction. Therefore, a blade rotating around the rotating shaft passes the high-pressure region with variable timing that depends on the position in the axial line direction. The level of periodic noise can be made lower than in a case that each blade passes the high-pressure region with uniform timing.

Since the gap between the extension and the impeller is kept approximately constant in the circumferential direction of the impeller, the level of noise can be made lower than in the method in which the tongue gap ratio is varied.

In the invention, it is preferable that at least an outside surface, in the radial direction, of the extension be formed with a hanging portion which projects outward in the radial direction by a length that varies depending on the position in the axial line direction.

With this measure, the hanging portion is disposed in a stagnant flow region (which corresponds to a dead region) that would otherwise be formed because a flow in the spiral flow passage would collide with the extension. Therefore, after colliding with the extension, the air flows parallel with the hanging portion without stagnation. As a result, the level of noise due to a stagnant flow can be made lower than in a case that the hanging portion is not formed. That is, filling in the stagnant flow region with the hanging portion suppresses generation of an unstable flow in the region concerned and suppresses a reverse flow from the spiral flow passage to the impeller. The generation of noise due to a reverse flow can thus be suppressed.

The hanging portion can be disposed only in the stagnant flow region by varying the length by which the hanging portion projects from the tongue outward in the radial direction according to the position in the axial line direction. Forming the hanging portion in this manner makes it possible to suppress increase of pressure loss of a flow in the spiral flow passage.

In the above configuration, it is preferable that the hanging portion be a slant surface which extends in a direction that crosses the outside surface, in the radial direction, of the extension, the outside surface extending parallel with the axial line direction.

Making the hanging portion a slant surface in this manner can suppress the generation of noise because a flow is less prone to be disordered (not disordered by steps) and air flows more smoothly parallel with the hanging portion than in a case that the hanging portion is a surface having steps.

Examples of the slant surface are a surface that is inclined outward in the radial direction as the position goes from the suction portion side to the impeller side and a surface that is inclined inward in the radial direction.

In the above configuration, it is preferable that the hanging portion be stepped so as to project outward in the radial direction from the extension by different lengths that depend on the position in the axial line direction.

With this measure, since the hanging portion is stepped, the direction of a flow parallel with the hanging portion is restricted more strongly and the generation of noise is suppressed more than in a case that it is a slant surface. That is, the step surfaces are formed at the positions between the projections having different projection lengths in the reverse rotational direction and a flow parallel with the axial line direction is restricted by those step surfaces. Therefore, a flow parallel with the hanging portion is converted into a flow going in the longitudinal direction of the spiral flow passage. The generation of noise due to the flow turbulence can thus be suppressed.

In the invention, it is preferable that the extension be a slant surface which extends in a direction that crosses the axial line.

Making the extension a slant surface in this manner can suppress the generation of noise because a flow is less prone to be disordered (not disordered by steps) and air flows more smoothly parallel with the extension than in a case that the hanging portion is a surface having steps.

Examples of the slant surface are a surface that is inclined in the reverse rotation direction as the position goes from the suction portion side to the impeller side and a surface that is inclined in the rotational direction.

In the invention, it is preferable that the extension be stepped so as to project in the reverse rotational direction by different lengths that depend on the position in the axial line direction.

With this measure, since the extension is stepped, the direction of a flow parallel with the extension is restricted more strongly and the generation of noise due to the flow turbulence is suppressed more than in a case that it is a slant surface. That is, the step surfaces are formed at the positions between the projections having different projection lengths in the reverse rotational direction and a flow parallel with the axial line direction is restricted by those step surfaces. Therefore, a flow parallel with the extension is converted into a flow going in the longitudinal direction of the spiral flow passage. The generation of noise due to the flow turbulence can thus be suppressed.

In the invention, it is preferable that the tongue be provided with a dividing surface which divides the tongue into one tongue that is located on the side of the suction portion and other tongue; and that the one tongue or the other tongue be provided with the extension, and the length of projection of the extension in the reverse rotational direction increase as the position goes away from the split surface starting from a region close to the split surface.

With this measure, where, for example, the casing that is formed with the tongue, the extension, etc. is formed by such a manufacturing method as injection molding, a draft taper can be secured easily and hence a shape with no under cut can be realized.

Forming the extension from a region close to the split surface allows the extension to occupy a wide range and thereby makes it possible to attain both of noise reduction and ease of molding of the extension.

In the invention, it is preferable that the tongue be provided with a split surface which divides the tongue into one tongue that is located on the side of the suction portion and other tongue; and that the one tongue or the other tongue be provided with the extension, the length of projection of the extension in the reverse rotational direction increase as the position goes away from the dividing surface starting from a region close to the split surface, and the extension be provided at least in the vicinity of an end, on the side of the suction portion, of the tongue.

With this measure, air that has been sucked to the impeller through the suction portion and flown out to the spiral flow passage flows so as to be concentrated in a region of the spiral flow passage that is opposite to the suction portion. Therefore, forming the extension adjacent to the suction-portion-side end of the tongue makes it possible to suppress the generation of noise effectively.

In the invention, it is preferable that a shield be disposed in a region close to the tongue in the spiral flow passage so as to project parallel with the axial line direction and to extend in a longitudinal direction of the spiral flow passage.

With this measure, air to flow toward the impeller which is located inside in the radial direction from the spiral flow passage which is located outside is interrupted, whereby the generation of noise is suppressed.

According to the centrifugal blower of the invention, since the high-pressure region formed varies depending on the position in the axial line direction, a blade passes the high-pressure region with variable timing that depends on the position in the axial line direction. This provides the advantage that the generation of periodic noise due to interference between the tongue and the impeller can be suppressed. The feature that the gap between the extension and the impeller is kept approximately constant in the circumferential direction of the impeller provides the advantage that the generation of noise can be suppressed.

EXPLANATION OF REFERENCE

1, 101, 201: Centrifugal blower
2: Impeller
3: Casing
4: Spiral flow passage
6: Tongue
9: Blade
12: Rotating shaft
13: split surface
16: Bellmouth (suction portion)
6U, 106U, 206U: Upper tongue (one tongue)
6L: Lower tongue (the other tongue)
19: Vane (shield)
20: Extension
107, 207: Hanging portion
C: Axial line

BEST MODE FOR CARRYING OUT THE INVENTION

Embodiment 1

A centrifugal blower according to a first embodiment of the present invention will be hereinafter described with reference to FIGS. 1-7.

Figure 1:
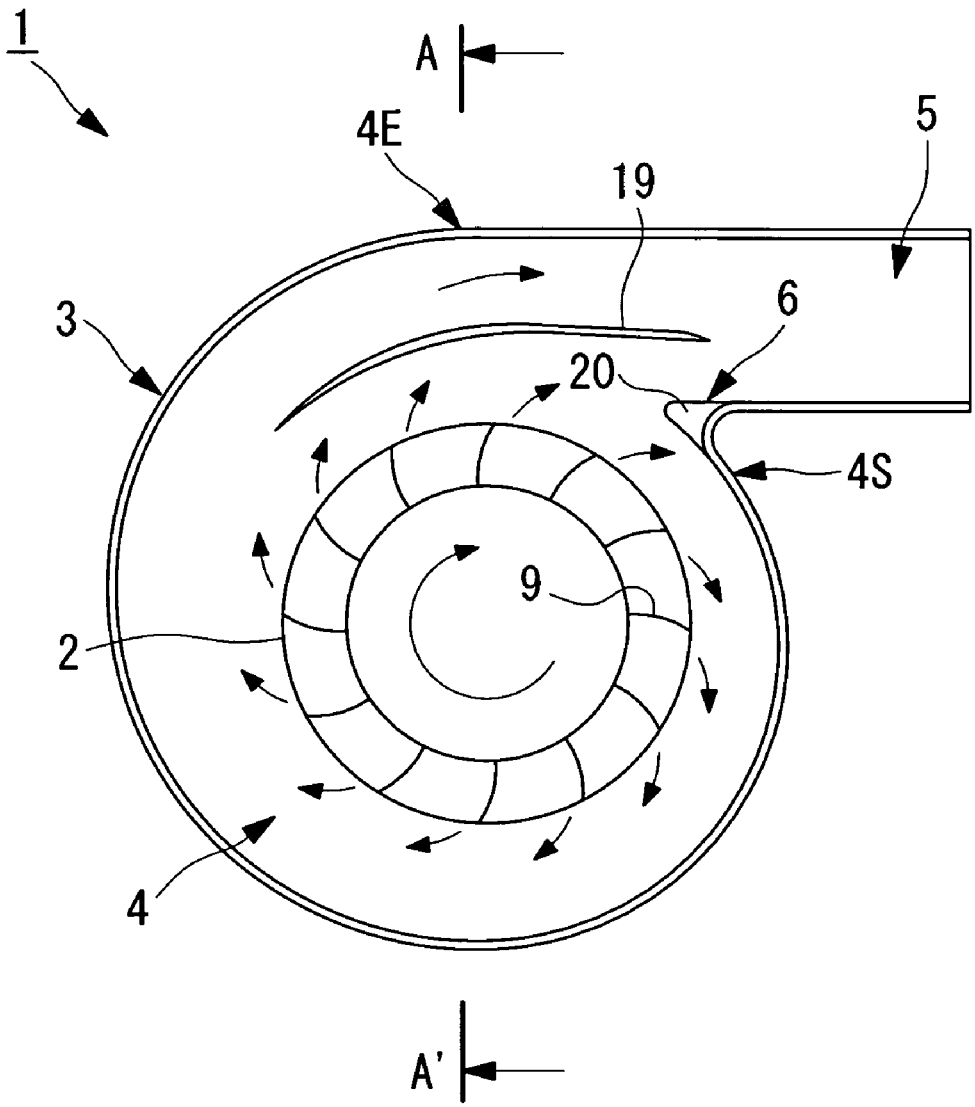
FIG. 1 is a schematic view showing the configuration of a centrifugal blower according to a first embodiment of the present invention.
Figure 2:
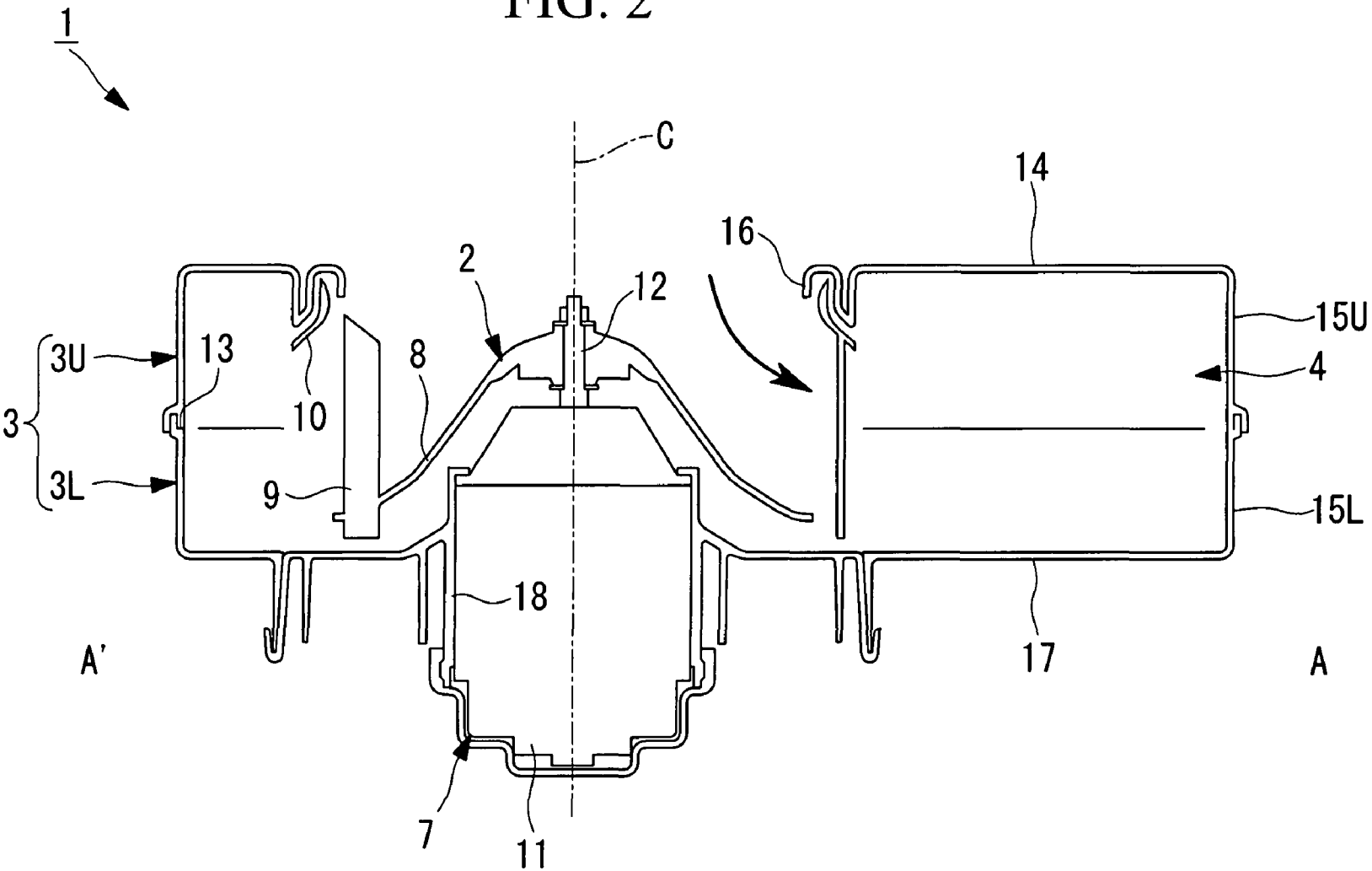
FIG. 2 is a sectional view showing the configuration of the centrifugal blower of FIG. 1.

FIG. 1 is a schematic view showing the configuration of a centrifugal blower according to this embodiment. FIG. 2 is a sectional view showing the configuration of the centrifugal blower of FIG. 1.

The centrifugal blower 1 according to the embodiment is used as a blower of a vehicular air conditioner. As shown in FIGS. 1 and 2, the centrifugal blower 1 is equipped with an impeller 2, a casing 3 which houses the impeller 2, a spiral flow passage 4 which is formed around the impeller 2 in the casing 3, a diffuser flow passage 5 which extends in a tangential direction from the winding end of the spiral flow passage 4, a tongue 6 which guides air from the spiral flow passage 4 to the diffuser flow passage 5 and suppress air inflow from the winding end to the winding origin of the spiral flow passage 4, and a drive unit 7 which rotation-drives the impeller 2 around an axial line C of a rotating shaft 12.

The diffuser flow passage 5 which guides air to individual flow passages (a face-side flow passage, a foot-side flow passage, a defrosting-side flow passage, etc.) of a vehicular air conditioner and devices (a heat exchanger for cooling, a heater core, etc.; not shown) which condition air that is introduced into the spiral flow passage 4 are disposed downstream of the spiral flow passage 4 of the centrifugal blower 1. Dampers whose opening/closing is controlled by a controller are disposed at the entrances of the flow passages, respectively, and the opening/closing of the dampers is controlled according to the operation mode of the vehicular air-conditioner. With this control, air is sent to a proper flow passage from the spiral flow passage 4.

Rotation-driven by the drive unit 7 and the rotating shaft 12, the impeller 2 takes air from the side of a shroud 10 into the space located inside blades 9 in the radial direction and compression-transports the air into the spiral flow passage 4 around the impeller 2 by applying centrifugal force to the air with the blades 9.

As shown in FIG. 2, the impeller 2 is equipped with a generally disc-shaped impeller bottom plate 8 which is rotation-driven around the axial line C, the plural blades 9 which are formed on the surface, located on the side opposite to the drive unit 7, of the impeller bottom plate 8 so as to be arranged along the same circumference, and the shroud 10 which is generally shaped like an annular plate, disposed coaxially with the blades 9 interposed between itself and the impeller bottom plate 8, and connects end portions of the blades 9.

In the embodiment, the impeller bottom plate 8 is curved in such a manner that its central portion projects more toward the shroud 10 side than its peripheral portion and thereby provides a housing space on the side of its surface that is opposed to the drive unit 7. Part of the drive unit 7 occupies this housing space. This makes it possible to reduce the dimension of the centrifugal blower 1 in the direction of the axial line C.

The impeller bottom plate 8 is curved gently from its central portion to its peripheral portion so as to be concave toward the shroud 10 side. Because of this shape, air that has been taken into the space inside the blades 9 in the radial direction is guided outward in the radial direction parallel with the impeller bottom plate 8 and is thereby supplied smoothly to the spaces between the blades 9.

Each blade 9 is a plate-like member that projects from the impeller bottom plate 8 toward the shroud 10 side parallel with the axial line C and is generally arc-shaped in a cross section taken perpendicularly to the axial line C. The blades 9 are arranged at regular intervals along the same circumference around the axial line C. The pitch P of the blades 9 is a parameter that is involved in determining the projection length of an extension 20 (described later).

The shroud 10 is inclined so as to come closer to the impeller bottom plate 8 as the position goes outward in the radial direction. The shroud 10 is curved like a horn whose width increases as the position goes closer to the impeller bottom plate 8, when viewed from the impeller bottom plate 8 side. With this structure, air that has been taken into the space inside in the blades 9 in the radial direction is guided outward in the radial direction parallel with the shroud 10 and thereby supplied smoothly to the spaces between the blades 9.

The drive unit 7, which serves to rotation-drive the impeller 2, is equipped with a motor 11 which generates rotational drive power and the rotating shaft 12 which connects the motor 11 to the impeller 2.

Disposed inside a cylinder 18 of the casing 3 (described later), the motor 11 generates rotational drive power on the basis of electric power that is supplied externally.

The rotating shaft 12 serves to transmit the rotational drive power generated by the motor 11 to the impeller bottom plate 8 of the impeller 2. The rotating shaft 12 is disposed so as to be rotatable around the axial line C.

As shown in FIGS. 1 and 2, the spiral flow passage 4 is a flow passage around the impeller 2 into which air that has been compression-transported by the impeller 2 flows.

The spiral flow passage 4 is shaped in such a manner that its cross section increases from a winding origin 4S to a winding end 4E, that is, in the rotational direction of the impeller 2 (in the clockwise direction in FIG. 1). In other words, the cross section of the spiral flow passage 4 is smallest at the winding origin 4S and largest at the winding end 4E. The spiral flow passage 4 is connected to the diffuser flow passage 5 at the winding end 4E.

The diffuser flow passage 5 serves to guide air that has flown out from the winding end 4E of the spiral flow passage 4 to the above-mentioned heat exchanger for cooling, the heater core, or the like.

The casing 3 is divided at a split surface 13 into an upper casing 3U (shown above in FIG. 2) which is opposed to the shroud 10 and a lower casing 3L (shown below in FIG. 2) which is opposed to the impeller bottom plate 8. The spiral flow passage 4 and the diffuser flow passage 5 are surrounded by the upper casing 3U and the lower casing 3L.

Figure 3:
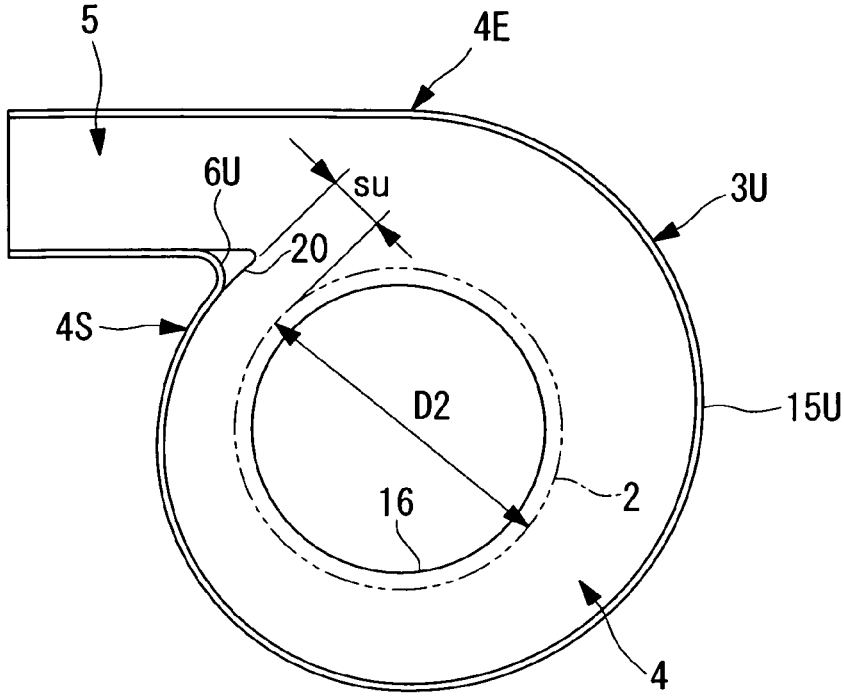
FIG. 3 is a schematic view showing the structure of an upper casing shown in FIG. 2.

FIG. 3 is a schematic view, as viewed from the lower casing side, showing the structure of the upper casing shown in FIG. 2.

As shown in FIGS. 2 and 3, the upper casing 3U is provided with a top plate 14 and an upper side wall 15U which constitute part of the outward form of the centrifugal blower 1, a bellmouth (suction portion) 16 through which to introduce air to the impeller 2, and an upper tongue (one tongue) 6U for guiding air from the spiral flow passage 4 to the diffuser flow passage 5.

The top plate 14 and the upper side wall 15U are also walls that serve to form the spiral flow passage 4 to the diffuser flow passage 5. The top plate 14 is a plate member that extends parallel with a surface that is perpendicular to the axial line C, and the upper side wall 15U is a wall that extends toward the lower casing 3L. A lower-casing-3L-side end portion of the upper side wall 15U corresponds to the split surface 13 and is engaged with an end portion of a lower side wall 15L.

The bellmouth 16 is an annular-plate-shaped member which is located adjacent to the top plate 14, opposed to the impeller 2, and curved smoothly so as to come closer to the lower casing 3L as the position goes inward in the radial direction.

The upper tongue 6U is a curved wall that connects a portion of the upper side wall 15U that is close to the winding origin 4S of the spiral flow passage 4 to a diffuser-flow-passage-5 portion of the upper side wall 15U. The upper tongue 6U constitutes the tongue 6 together with a lower tongue 6L.

The upper tongue 6U is a generally cylindrical curved wall extending parallel with the axial line C and is formed so that the gap su between itself and the impeller 2 is about 8% to about 10% if the diameter D2 of the impeller 2 is assumed to be 100%.

In the embodiment, the radius of the generally cylindrical curved wall of the upper tongue 6U is about 12 mm and the gap su between the upper tongue 6U and the impeller 2 is about 13 mm. However, they are not limited these values.

Figure 4:
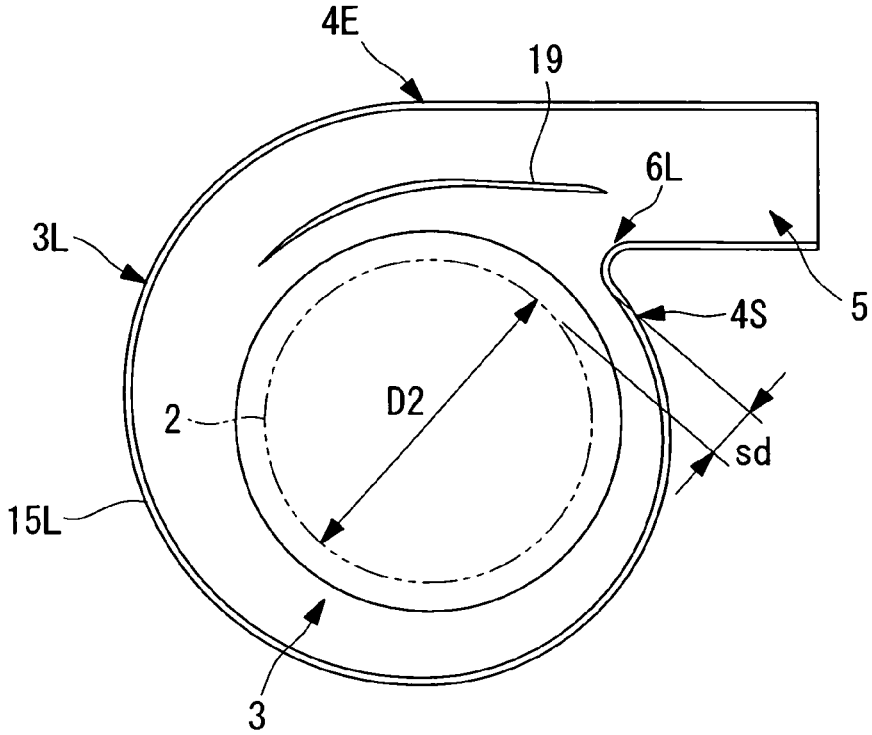
FIG. 4 is a schematic view showing the structure of a lower casing shown in FIG. 2.

FIG. 4 is a schematic view, as viewed from the upper casing side, showing the structure of the lower casing shown in FIG. 2.

As shown in FIGS. 2 and 4, the lower casing 3L is provided with a lower bottom plate 17 and a lower side wall 15L which constitute part of the outward form of the centrifugal blower 1, a cylinder 18 which houses the drive unit 7, a lower tongue (the other tongue) 6L for guiding air from the spiral flow passage 4 to the diffuser flow passage 5, and a vane (shield) 19 for preventing air from flowing reversely toward the impeller 2.

The bottom plate 17 and the lower side wall 15L are also walls that serve to form the spiral flow passage 4 to the diffuser flow passage 5. The bottom plate 17 is a plate member that extends parallel with a surface that is perpendicular to the axial line C, and the lower side wall 15L is a wall that extends toward the upper casing 3U. An upper-casing-3U-side end portion of the lower side wall 15L corresponds to the dividing surface 13 and is engaged with the end portion of the upper side wall 15U.

The cylinder 18 is a cylindrical member which is located to a region of the lower plate 17 that is opposed to the impeller 2 and extends along the axial line C. A motor as the drive unit 7 is disposed inside the cylinder 18.

The lower tongue 6L is a curved wall that connects a portion of the lower side wall 15L that is close to the winding origin 4S of the spiral flow passage 4 to a diffuser-flow-passage-5 portion of the lower side wall 15L. The lower tongue 6L constitutes the tongue 6 together with the upper tongue 6U.

Figure 5:
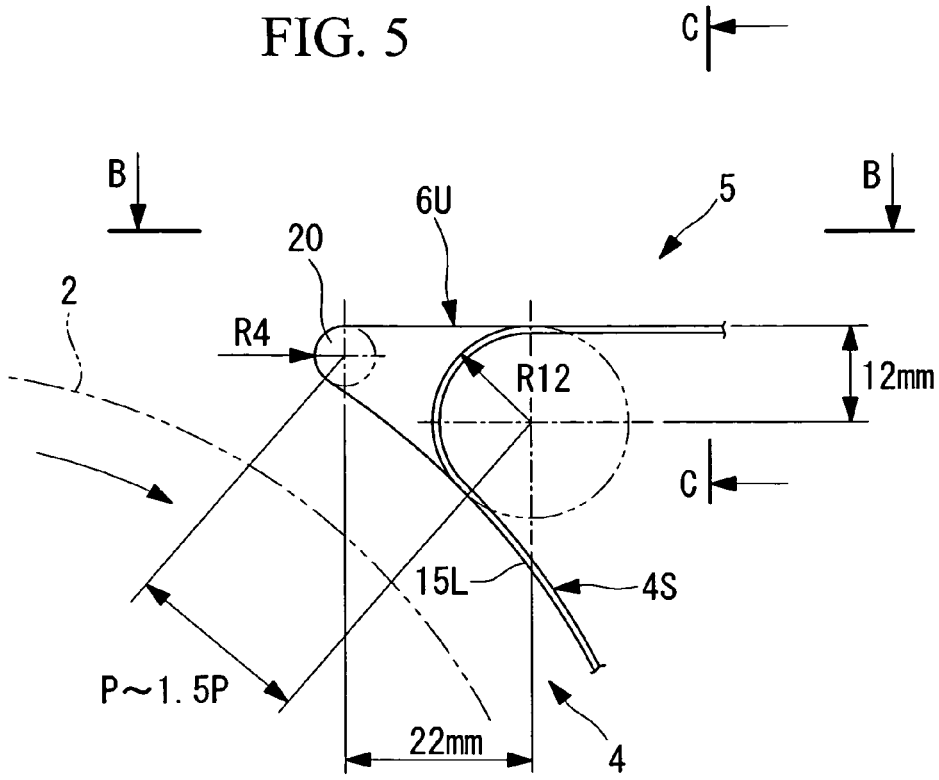
FIG. 5 is an enlarged partial view showing the structure of an upper tongue shown in FIG. 3.

FIG. 5 is an enlarged partial view showing the structure of the upper tongue shown in FIG. 3 and is a see through view of the top tongue as viewed from the top plate 14.

As shown in FIGS. 3 and 5, the upper tongue 6U is provided with an extension 20 which projects along a circumference around the axial line C in a rotational direction (hereinafter referred to as "reverse rotational direction") that is reverse to the rotational direction of the impeller 2.

Figure 6:
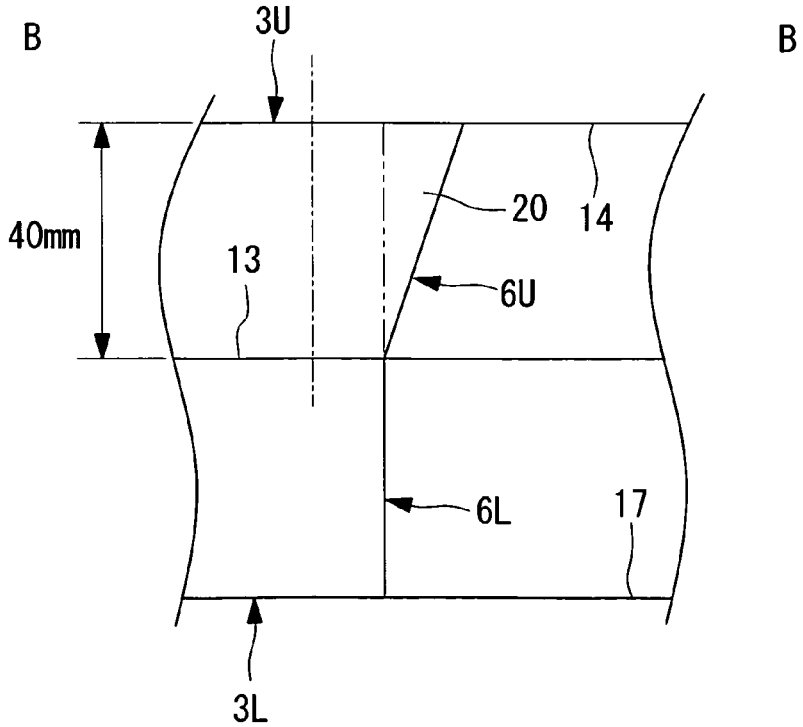
FIG. 6 is an enlarged partial view showing the structure of the upper tongue shown in FIG. 5.

FIG. 6 is an enlarged partial view showing the structure of the upper tongue shown in FIG. 5 and a sectional view taken along line B-B in FIG. 5.

As shown in FIGS. 5 and 6, the extension 20 is a slant curved surface that projects more in the reverse rotational direction and is reduced in radius as the position goes from the split surface 13 to the top plate 14. The radius of the extension 20 at the split surface 13 is approximately the same as the radius of the lower tongue 6L.

The projection length of the extension 20 is set in a range of P to 1.5 P, where P is the pitch of the blades 9 of the impeller 2.

In varying the timing of interference between the blades 9 and the tongue 6, it is ideal to vary the projection length by one blade pitch. However, since an outward flow in the radial direction that occurs after passage between blades 9 is not necessarily uniform, the additional half-pitch variation is effective in reducing the interference (a further variation requires something unreasonable in terms of dimensional limitations of the casing).

In the embodiment, the radius of the extension 20 is about 12 mm at the split surface 13 and is about 4 mm at the tip and the distance from the origin of the radius at the split surface 13 to that at the tip (i.e., a length in the extending direction of the diffuser flow passage 5) is about 22 mm.

However, the shape of the extension 20 is not limited to the one having the above dimensions.

That surface of the extension 20 which is opposed to the impeller 2 is a generally cylindrical curved surface that extends from the upper wide wall 15U along a circumference around the axial line C. Therefore, the gap su between the extension 20 and the impeller 2 is a constant, prescribed value in a range of about 8% to about 10% of the diameter of the impeller 2 like a gap sd between the lower tongue 6L and the impeller 2.

Forming the upper tongue 6U and the lower tongue 6L in the above manner makes it easier to secure a draft taper and to realize a shape with no under cut. As a result, the casing 3 can be formed by such a manufacturing method as injection molding.

Figure 7:
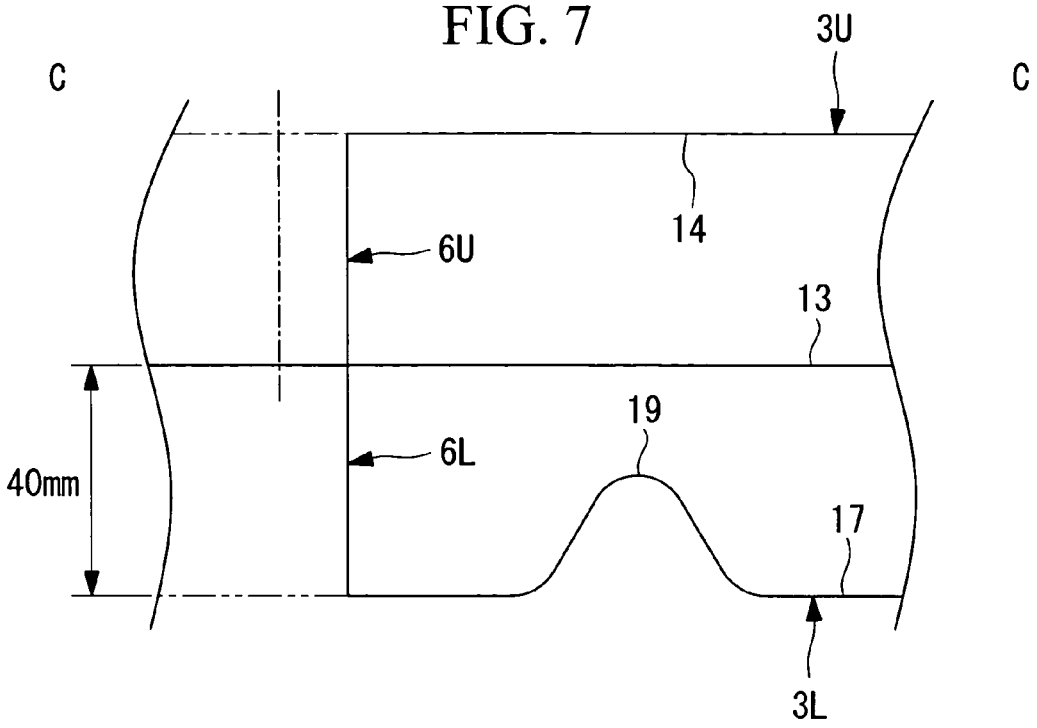
FIG. 7 is an enlarged partial view showing the structure of a vane shown in FIG. 4.

FIG. 7 is an enlarged partial view showing the structure of the vane shown in FIG. 4 and is a sectional view taken along line C-C in FIG. 4.

As shown in FIGS. 4 and 7, the vane 19 is a ridge-shaped member which projects from a portion of the lower bottom plate 17 that serves to form the spiral flow passage 4 toward the upper casing 3U and extends in the longitudinal direction of the spiral flow passage 4. The vane 19 has a gently curved, mountain-shaped cross section.

The vane 19 extends from a position close to the winding end 4E of the spiral flow passage 4 to a position close to the lower tongue 6L in the diffuser flow passage 5.

The vane 19 may have either a gently curved, mountain-like shape that projects toward the upper casing 3U (the case described above) or a plate-like shape that projects toward the upper casing 3U. There are no particular restrictions in this respect.

Furthermore, the vane 19 may be such as to project from the top plate 14 toward the lower casing 3L. There are no particular restrictions in this respect.

The vane 19 may be either formed in the spiral flow passage 4 as in the embodiment or omitted. There are no particular restrictions in this respect.

Next, a description will be made of a blowing method of the centrifugal blower 1 having the above configuration.

To blow air using the centrifugal blower 1, as shown in FIGS. 1 and 2, electric power is supplied to the motor 11 of the drive unit 7 and the motor 11 rotation-drives the impeller 2.

As the impeller 2 rotates, air flows through the bellmouth 16 into the space located inside the blades 9 in the radial direction. The air thus introduced is compression-transported outward in the radial direction of the rotating impeller 2 and flows into the spiral flow passage 4.

The air that has flown into the spiral flow passage 4 flows through the spiral flow passage 4 from the winding origin 4S toward the winding end 4E side. In the spiral flow passage 4, as the position goes downward, the flow passage cross section increases and hence the air flow speed decreases and the static pressure rises. After flowing through the spiral flow passage 4, the air flows from the winding end 4E into the diffuser flow passage 5, where the flow speed decreases and the static pressure rises further.

Then, the air flows out of the diffuser flow passage 5, that is, the centrifugal blower 1.

A description will now be made of a manner of air flow near the tongue 6, which is an important feature of the invention.

As shown in FIG. 1, when air that has flown through the spiral flow passage 4 flows into the diffuser flow passage 5 from the winding end 4E, it collides with the tongue 6 and forms a high-pressure region near the tongue 6.

Since the lower tongue 6L extends parallel with the axial line 6L, a high-pressure region formed by the lower tongue 6L has equipressure lines that are approximately parallel with the surface of the lower tongue 6L, that is, approximately parallel with the axial line C. On the other hand, since the upper tongue 6U is provided with the extension 20 which is the surface inclined with respect to the axial line C, a high-pressure region formed by the upper tongue 6U has equipressure lines that are approximately parallel with the surface of the extension 20, that is, inclined with respect to the axial line C.

More specifically, the high-pressure region formed by the upper tongue 6U is a region that projects more in the reverse rotational direction as the position goes closer to the top plate 14.

As the impeller 2 rotates, the blades 9 move crossing the high-pressure region that is formed by the tongue 6.

First, a top-plate-14-side end portion of a blade 9 enters the high-pressure region which projects in the reverse rotation direction. Then, the portion of the blade 9 that enters the high-pressure region moves gradually toward the lower bottom plate 17 side.

After the blade 9 has fully entered the high-pressure region formed by the upper tongue 6U, it instantaneously enters the high-pressure region formed by the lower tongue 6L.

On the other hand, because of a pressure difference, the air in the high-pressure region in the spiral flow passage 4 flows toward the impeller 2 which is located inside the radial direction. The air to flow toward the impeller 2 is interrupted by the vane 19 and comes to flow along the vane 19 toward the diffuser flow passage 5.

Since the flow to go from the spiral flow passage 4 to the impeller 2 is interrupted, noise that would otherwise be generated by air flowing reversely to the impeller 2 can be suppressed.

With the above configuration, air that has flown from the impeller 2 into the spiral flow passage 4 flows along the spiral flow passage 4 and collides with the extension 20 to form a high-pressure region. Since the region where the high-pressure region is formed is influenced by the position where the air collides with the extension 20, it varies depending on the position in the direction parallel with the axial line C. Therefore, a blade 9 rotating around the rotating shaft 12 passes the high-pressure region with variable timing that depends on the position in the direction parallel with the axial line C. The level of periodic noise can be made lower than in a case that each blade 9 passes through the high-pressure region with uniform timing.

Since the gap between the extension 20 and the impeller 2 is approximately constant in the circumferential direction of the impeller 2, the level of noise generated by the centrifugal blower 1 can be made lower than in the method of Patent Citation 1 in which the tongue gap ratio is varied.

Making the extension 20 a slant surface can suppress the generation of noise because a flow is less prone to be disordered (not disordered by steps) and air flows more smoothly parallel with the extension 20 than in a case that the extension 20 is formed as a surface having steps.

Formed from the position close to the dividing surface 13, the extension 20 can be formed so as to cover a wide range. This can make the effect of suppressing the generation of noise more reliable.

Air that has been sucked to the impeller 2 through the suction portion and flown out to the spiral flow passage 4 flows so as to be concentrated in a region of the spiral flow passage 4 that is opposite to the bellmouth 14, that is, a region on the lower bottom plate 17 side. Therefore, forming the extension 20 adjacent to the bellmouth-side end of the tongue 6 makes it possible to suppress the generation of noise effectively.

Either only the upper tongue 6U (the case described above) or only the lower tongue 6L may be provided with the extension 20. As another alternative, both of the upper tongue 6U and the lower tongue 6L may be provided with the extension 20. There are no restrictions in this respect.

The extension 20 may be either a slant surface that projects more in the reverse rotational direction as the position goes closer to the top plate 14 (the case described above) or a slant surface that projects more in the reverse rotational direction as the position goes closer to the lower bottom plate 17. There are no particular restrictions in this respect.

The casing 3 may either consist of the upper casing 3U and the lower casing 3L (two divisional members; the case described above) or consist of divisional members that are separated by another dividing method. As another alternative, the casing 3 be formed integrally. There are no particular restrictions in this respect.

Embodiment 2

Next, a second embodiment of the invention will be described with reference to FIGS. 8-10.

A centrifugal blower according to this embodiment is the same in basic configuration as the centrifugal blower according to the first embodiment, and is different from the latter in the structure of the upper tongue. Therefore, in this embodiment, the structure of the upper tongue and components neighboring it will be described with reference to FIGS. 8-10 and the other components etc. will not be described.

Figure 8:
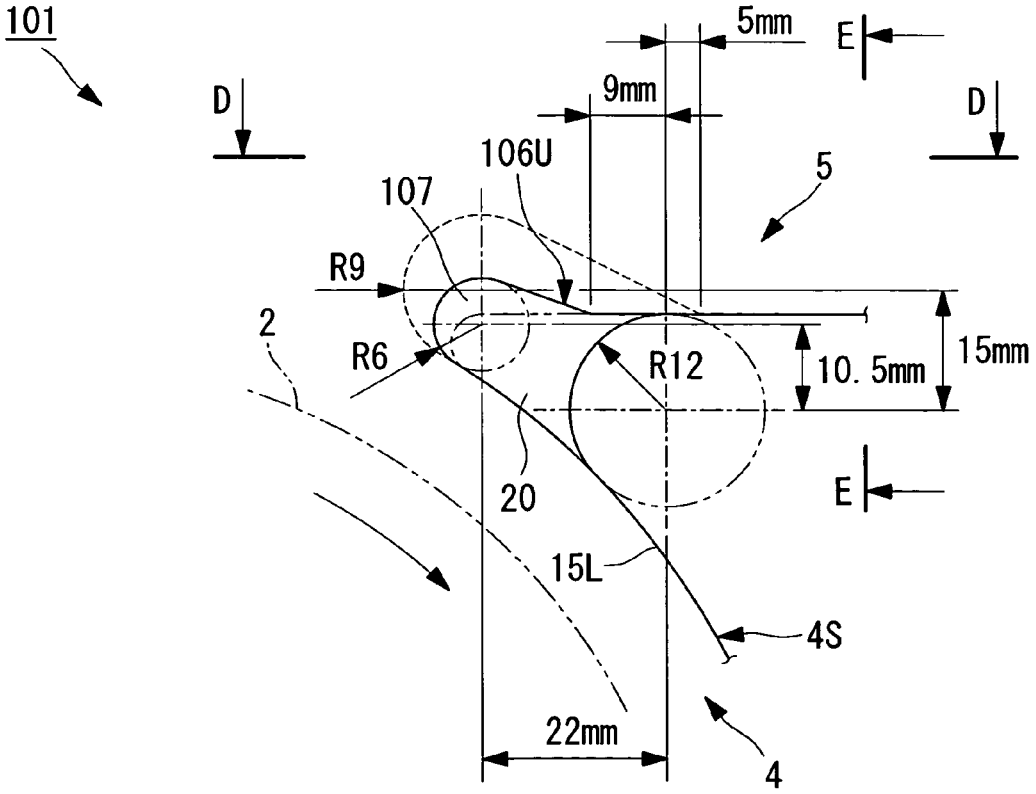
FIG. 8 is an enlarged partial view showing the structure of an upper tongue of a centrifugal blower according to a second embodiment of the invention.

FIG. 8 is an enlarged partial view showing the structure of the upper tongue of the centrifugal blower according to this embodiment and is a see through view of the upper tongue as viewed from the top plate 14.

Components having the same components in the first embodiment will be given the reference symbols as the latter and will not be described.

As shown in FIG. 8, an upper tongue (one tongue) 106U of the centrifugal blower 101 is a curved wall that connects a portion of the upper side wall 15U that is close to the winding origin 4S of the spiral flow passage 4 to a diffuser-flow-passage-5 portion of the upper side wall 15U. The upper tongue 106U is thus part of the tongue 6.

As shown in FIG. 8, the upper tongue 106U is provided with an extension 20 which projects in the reverse rotational direction along a circumference around the axial line C and a hanging portion 107 which projects from the extension 20 outward in the radial direction having the axial line C as the origin.

Figure 9:
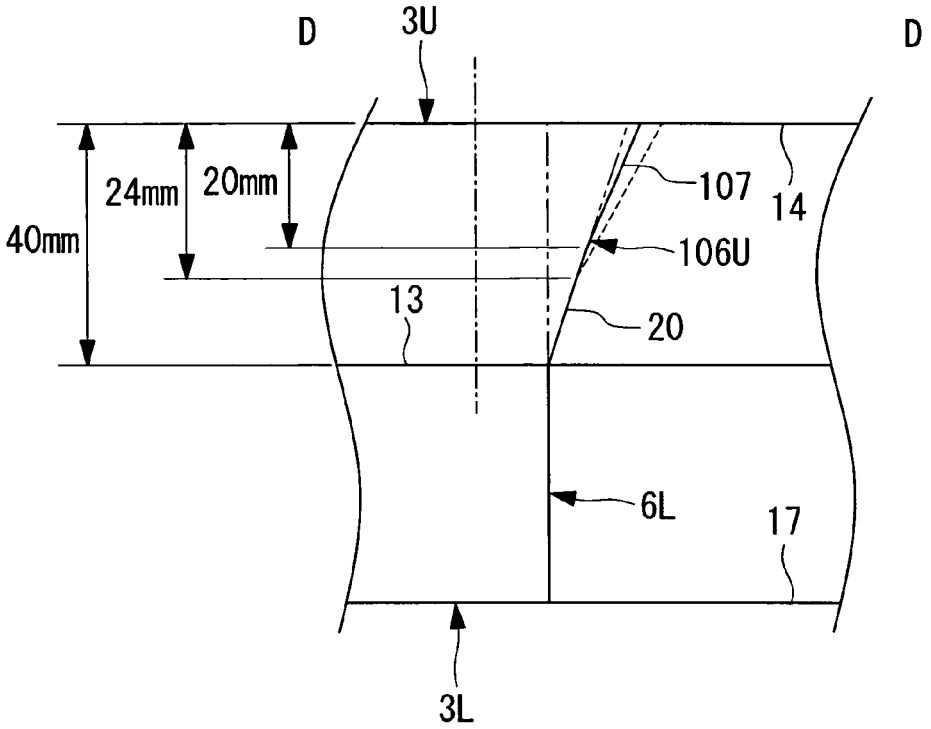
FIG. 9 is an enlarged partial view showing the structure of an upper tongue shown in FIG. 8.

FIG. 9 is an enlarged partial view showing the structure of the upper tongue shown in FIG. 8 and is a sectional view taken along line D-D in FIG. 8. FIG. 10 is an enlarged partial view showing the structure of the upper tongue shown in FIG. 8 and is a sectional view taken along line E-E in FIG. 8.

Figure 10:
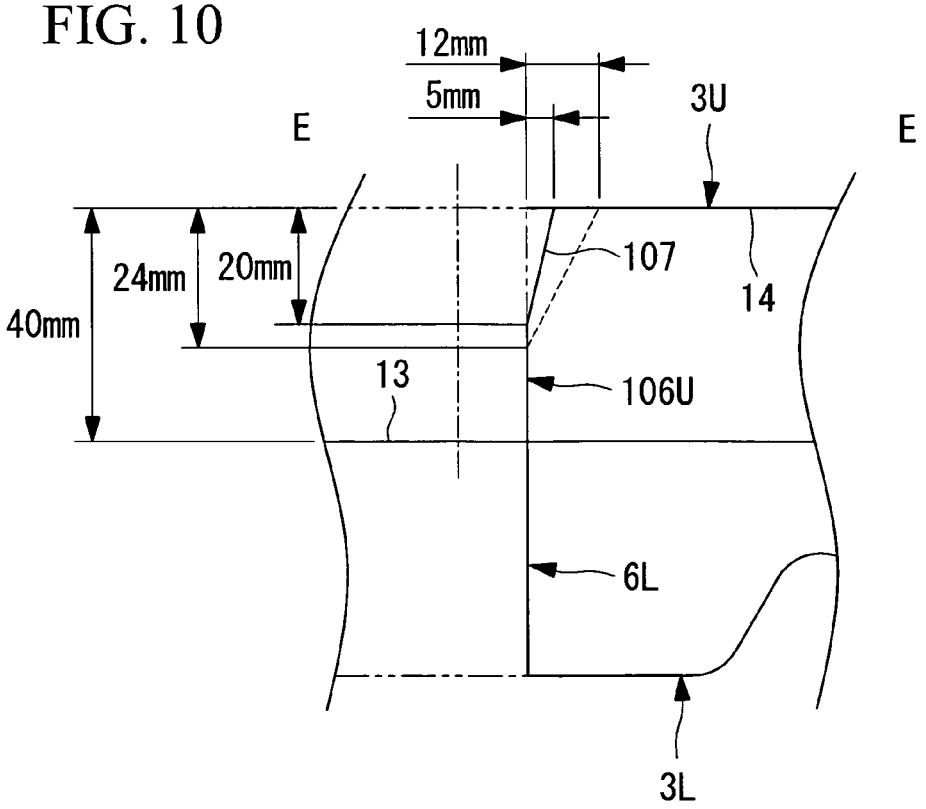
FIG. 10 is an enlarged partial view showing the structure of the upper tongue shown in FIG. 8.

As shown in FIGS. 8-10, the hanging portion 107 is formed of a conical surface whose diameter increases as the position goes from the split surface 13 toward the top plate 14 and a slant surface that projects outward in the radial direction.

The bottom surface of the above conical shape is a circle that is in contact with that surface of the extension 20 which is opposed to the impeller 2.

Forming the hanging portion 107 in this manner makes it easier to secure a draft taper and to realize a shape with no under cut. As a result, the casing 3 can be formed by such a manufacturing method as injection molding.

More specifically, as shown in FIGS. 8 and 9, the hanging portion 107 has a slant surface that projects more from the extension 20 into the diffuser flow passage 5 as the position goes from the split surface 13 toward the top plate 14. The projection length into the diffuser flow passage 5 is greatest at the tip (i.e., the end in the reverse rotational direction) of the extension 20 and decreases as the position goes downstream (rightward in FIG. 8) along an air flow.

It is desirable that the projection length of the hanging portion 107 into the diffuser flow passage 5, that is, the radius of the bottom surface of the conical shape constituting the hanging portion 107, be a prescribed value that is 75% or less, even preferably 50% to 75%, of the radius R of the upper tongue 106U at the dividing surface 13.

Forming the hanging portion 107 in this manner makes it possible to fill in a reverse flow region (or a region corresponding to a stagnant region or a dead region) that would otherwise be formed close to the extension 20 outside it in the radial direction. As a result, an unstable flow in the reverse flow region can be eliminated and the pressure loss of a flow (main flow) along the longitudinal direction of the spiral flow passage and the diffuser flow passage 5 can be reduced.

In the embodiment, the radius of the extension 20 at the split surface 13 is about 12 mm and the distance from the origin of the radius of the extension 20 at the dividing surface 13 to the origin of the radius of the bottom surface of the above-mentioned conical shape (i.e., a length in the extending direction of the diffuser flow passage 5) is about 22 mm, and the radius of the bottom surface of the conical shape is about 6 mm (indicated by solid lines in FIGS. 8-10) or about 9 mm (indicated by broken lines in FIGS. 8-10).

However, the shape of the hanging portion 107 is not limited to the ones having the above dimensions.

Next, a description will be made of a blowing method of the centrifugal blower 101 having the above configuration. The actions of the impeller 2, the extension 20, and the vane 19 are the same as in the first embodiment and hence will not be described.

As shown in FIG. 8, air that has flown through the spiral flow passage 4 collides with the tongue 6. The air thus forms a high-pressure region near the tongue 6 and also forms an unstable flow region outside the extension 20 in the radial direction, that is, near the hanging portion 107.

The air in the unstable region flows smoothly toward the diffuser flow passage 5 parallel with the wall surface of the hanging portion 107 which projects from the extension 20 outward in the radial direction.

In the above structure, the hanging portion 107 is disposed in a stagnant flow region (which corresponds to a dead region) that would otherwise be formed because a flow in the spiral flow passage 4 would collide with the extension 20. Therefore, after colliding with the extension 20, the air flows parallel with the hanging portion 107 without stagnation. As a result, the level of noise due to a stagnant flow can be made lower than in a case that the hanging portion 107 is not formed. That is, filling in the stagnant flow region with the hanging portion 107 suppresses generation of an unstable flow in the region concerned and reduces the rate of a reverse flow from the spiral flow passage 4 to the impeller 2. The generation of noise due to a reverse flow can thus be suppressed.

The hanging portion 107 can be disposed suitably for a stagnant flow region by changing the length by which the hanging portion 107 projects from the extension 20 outward in the radial direction depending on the position in the direction that is parallel with the axial line C. Forming the hanging portion 107 in this manner makes it possible to suppress increase of pressure loss of a flow in the spiral flow passage 4.

Making the hanging portion 107 a slant surface can suppress the generation of noise because a flow is less prone to be disordered (not disordered by steps) and air flows more smoothly parallel with the hanging portion 107 than in a case that the hanging portion 107 is formed as a surface having steps.

Modification 1 of Embodiment 2

Next, a first modification of the second embodiment of the invention will be described with reference to FIGS. 11-13.

A centrifugal blower according to this modification is the same in basic configuration as the centrifugal blower according to the second embodiment, and is different from the latter in the structure of the upper tongue. Therefore, in this modification, the structure of the upper tongue and components neighboring it will be described with reference to FIGS. 11-13 and the other components etc. will not be described.

Figure 11:
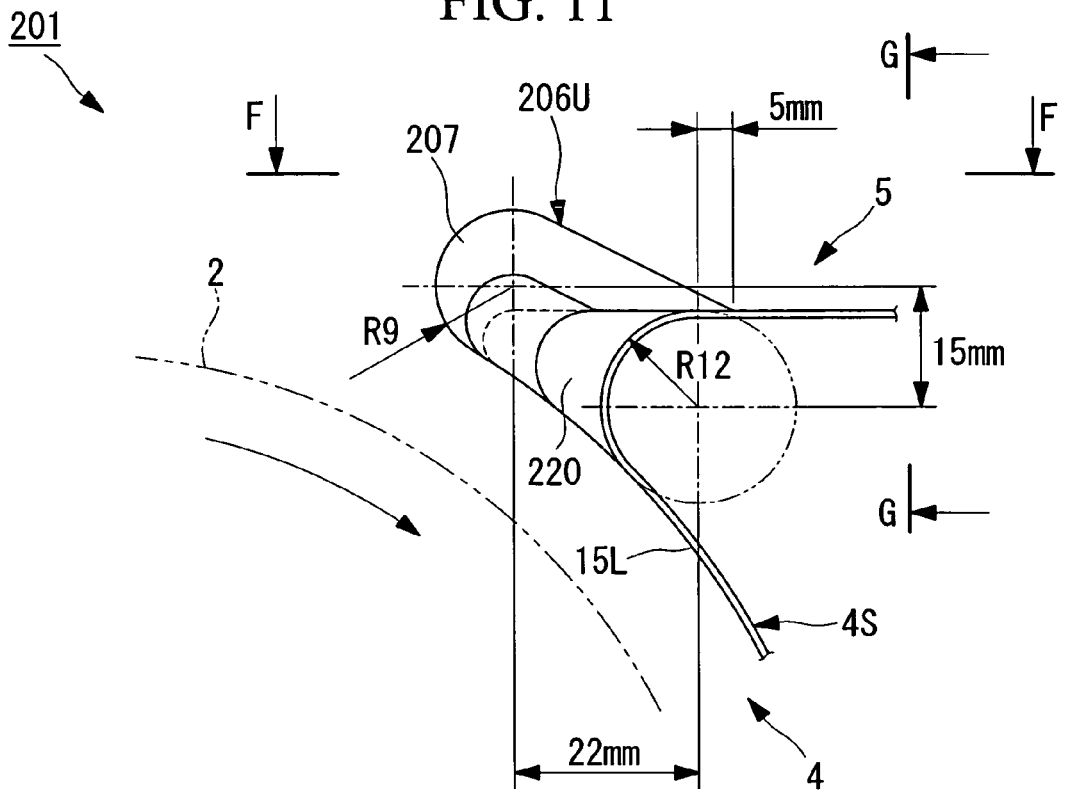
FIG. 11 is an enlarged partial view showing the structure of an upper tongue of a centrifugal blower according to a first modification of the second embodiment of the invention.

FIG. 11 is an enlarged partial view showing the structure of the upper tongue of the centrifugal blower according to this modification and is a see through view of the upper tongue as viewed from the top plate 14.

Components having the same components in the second embodiment will be given the reference symbols as the latter and will not be described.

As shown in FIG. 11, an upper tongue (one tongue) 206U of the centrifugal blower 201 is a stepped cylindrical wall that connects a portion of the upper side wall 15U that is close to the winding origin 4S of the spiral flow passage 4 to a diffuser-flow-passage-5 portion of the upper side wall 15U. The upper tongue 206U is thus part of the tongue 6.

As shown in FIG. 11, the upper tongue 206U is provided with an extension 220 which projects in the reverse rotational direction along a circumference around the axial line C and a hanging portion 207 which projects from the extension 220 outward in the radial direction having the axial line C as the origin.

Figure 12:
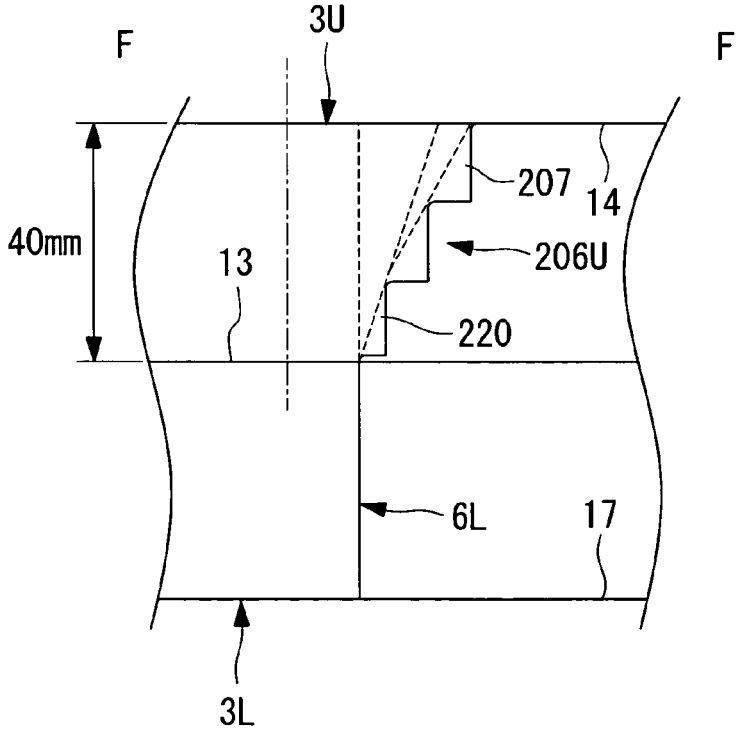
FIG. 12 is an enlarged partial view showing the structure of the upper tongue shown in FIG. 11.

FIG. 12 is an enlarged partial view showing the structure of the upper tongue shown in FIG. 11 and is a sectional view taken along line F-F in FIG. 11. FIG. 13 is an enlarged partial view showing the structure of the upper tongue shown in FIG. 11 and is a sectional view taken along line G-G in FIG. 11.

Figure 13:
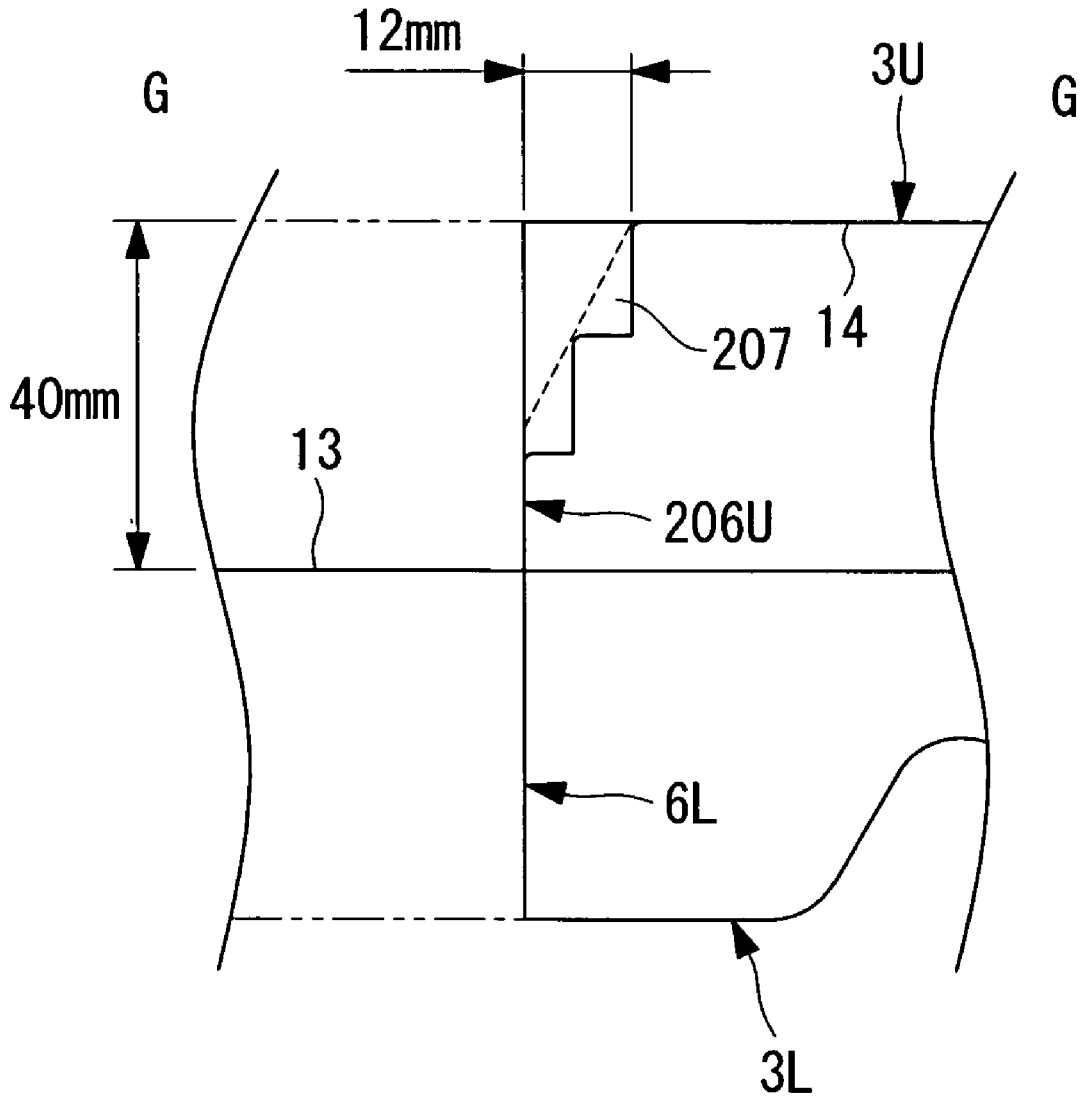
FIG. 13 is an enlarged partial view showing the structure of the upper tongue shown in FIG. 11.

As shown in FIGS. 12 and 13, the extension 220 is a generally cylindrical surface that is stepped in such a manner that the projection length in the reverse rotational direction increases as the position goes from the dividing surface 13 to the top plate 14. The radius of the cylindrical surface decreases as the projection length in the reverse rotational direction increases. The radius of the extension 220 at the split surface 13 is approximately the same as the radius of the top tongue 6U.

The projection length of the extension 220 is set in a range of P to 1.5 P, where P is the pitch of the blades 9 of the impeller 2.

That surface of the extension 220 which is opposed to the impeller 2 is a generally cylindrical curved surface that extends from the upper wide wall 15U along a circumference around the axial line C. Therefore, the gap su between the extension 220 and the impeller 2 is a constant, prescribed value in a range of about 8% to about 10% of the diameter of the impeller 2 like a gap sd between the lower tongue 61 and the impeller 2.

As shown in FIGS. 12 and 13, the hanging portion 207 is formed by plural cylindrical surfaces whose radii increase as the position goes from the dividing surface 13 to the top plate 14 and a surface whose length of outward projection in the radial direction increases.

Next, a description will be made of a blowing method of the centrifugal blower 201 having the above configuration. The actions of the impeller 2 and the vane 19 are the same as in the first embodiment and hence will not be described.

As shown in FIG. 11, air that has flown through the spiral flow passage 4 collides with the upper tongue 206U and forms a high-pressure region near the upper tongue 206U.

Since the upper tongue 206U is provided with the extension 220, the high-pressure region formed by the upper tongue 206U has equipressure lines that are approximately parallel with the surface of the extension 220, that is, stepped equipressure lines. More specifically, the high-pressure region formed by the upper tongue 206U is a stepped region that projects more in the reverse rotational direction as the position goes closer to the top plate 14.

As the impeller 2 rotates, the blades 9 move crossing the high-pressure region that is formed by the tongue 6.

First, a top-plate-14-side end portion of a blade 9 enters the high-pressure region which projects in the reverse rotational direction. Then, the portion of the blade 9 that enters the high-pressure region moves gradually to the lower bottom plate 17 side.

On the other hand, as shown in FIG. 11, an unstable flow region is formed outside the extension 220 in the radial direction, that is, near the hanging portion 207.

The air in the unstable region flows smoothly toward the diffuser flow passage 5 parallel with the wall surface of the hanging portion 207 which projects from the extension 220 outward in the radial direction.

At this time, the air to flow parallel with the axial line C (i.e., in the direction perpendicular to the paper surface of FIG. 11) is interrupted by the step surfaces of the extension 220 and the hanging portion 207. In particular, the air to flow from the lower casing 3L toward the upper casing 3U is interrupted and comes to flow toward the diffuser flow passage 5.

With the above structure, since the extension 220 and the hanging portion 207 are stepped, the direction of a flow parallel with the extension 220 and the hanging portion 207 is restricted more strongly and the generation of noise is suppressed more than in a case that they are slant surfaces. That is, the step surfaces are formed at the positions between the projections having different projection lengths in the reverse rotational direction and a flow parallel with the axial line C is restricted by those step surfaces. Therefore, a flow parallel with the extension 220 and the hanging portion 207 is converted into a flow going in the longitudinal direction of the spiral flow passage 4 and the diffuser flow passage 5. The generation of noise due to the flow turbulence can thus be suppressed.

The technical scope of the invention is not limited to the above embodiments, and various modifications are possible without departing from the spirit and scope of the invention.

For example, although in the above embodiments the invention is applied to the centrifugal blower of a vehicular air-conditioner, the application field of the invention is not limited to centrifugal blowers used in vehicular air-conditioners and the invention can be applied to those used in other various apparatus.

The invention claimed is:

1. A centrifugal blower comprising:

an impeller provided with plural blades around a rotating shaft;

a casing which houses the impeller and has a suction portion at one end in an axial line direction of the rotating shaft;

a spiral flow passage formed around the impeller in the casing;

a tongue for suppressing inflow of air from a winding end to a winding origin of the spiral flow passage; and an extension which is provided at a tip of the tongue in a reverse rotational direction that is reverse to a rotational direction of the impeller and which projects in the reverse rotational direction by a length that varies depending on the position in the axial line direction while the gap between the extension and the impeller in a radial direction of the impeller is kept approximately constant.

2. The centrifugal blower according to claim 1, wherein at least an outside surface, in the radial direction, of the extension is formed with a hanging portion which projects outward in the radial direction by a length that varies depending on the position in the axial line direction.

3. The centrifugal blower according to claim 2, the hanging portion is a slant surface which extends in a direction that crosses the outside surface, in the radial direction, of the extension, the outside surface extending parallel with the axial line direction.

4. The centrifugal blower according to claim 2, the hanging portion is stepped so as to project outward in the radial direction from the extension by different lengths that depend on the position in the axial line direction.

5. The centrifugal blower according to claim 1, wherein the extension is a slant surface which extends in a direction that crosses the axial line.

6. The centrifugal blower according to claim 1, wherein the extension is stepped so as to project in the reverse rotational direction by different lengths that depend on the position in the axial line direction.

7. The centrifugal blower according to claim 1, wherein:

the tongue is provided with a split surface which divides the tongue into one tongue that is located on the side of the suction portion and other tongue; and the one tongue or the other tongue is provided with the extension, and the length of projection of the extension in the reverse rotational direction increases as the position goes away from the split surface starting from a region close to the dividing surface.

8. The centrifugal blower according to 7, wherein the extension is provided at least in the vicinity of an end, on the side of the suction portion, of the tongue.

9. The centrifugal blower according to claim 1, further comprising a shield which is disposed in a region close to the tongue in the spiral flow passage, projects parallel with the axial line direction, and extends in a longitudinal direction of the spiral flow passage.

* * * * *